United States Patent [19]

Symons

[11] 4,442,417

[45] Apr. 10, 1984

[54] UNIFORM FIELD SOLENOID MAGNET WITH OPENINGS

[75] Inventor: Robert S. Symons, Los Altos, Calif.

[73] Assignee: Varian Associates, Inc., Palo Alto, Calif.

[21] Appl. No.: 342,957

[22] Filed: Jan. 26, 1982

[51] Int. Cl.[3] ..... H01F 7/00

[52] U.S. Cl. ..... 335/210; 315/535

[58] Field of Search ..... 335/210, 213; 315/5.37, 315/5.38, 5.34, 5.35, 5.47, 5.48, 5.52

[56] References Cited

U.S. PATENT DOCUMENTS 2,843,788 7/1958 Peter ..... 315/5.35 X 3,716,746 2/1973 Kraus ..... 315/5.35

*Primary Examiner*—George Harris

*Attorney, Agent, or Firm*—Stanley Z. Cole; Richard B. Nelson; Peter J. Sgarbossa

[57] ABSTRACT

A solenoidal magnet coil is used to generate an axial field for focusing a beam of electrons through a linear-beam electron tube. In high-power tubes, the coil typically cannot extend over the entire length of the focused electron beam because it would interfere with the waveguide used to carry out the generated wave power. Thus the axial magnetic field strength falls off near the output end, a region in which it would be desirable to have it uniform or even slightly increasing. Very often the coil is foil-wound and its output end has a notch to allow passage of the waveguide. A similar notch 180 degrees away compensates the sideways distortion of field caused by displacement of coil current away from the notch impediment. In the non-notched regions the current spreads throughout the coil cross-section, but there is still a fall-off of field strength on the axis due to current displacement away from the output end. The invention comprises a second pair of notches in the end of the coil opposite the output end and azimuthally spaced between the first pair. These notches deflect the current toward the output, compensating the magnetic field fall-off.

9 Claims, 9 Drawing Figures

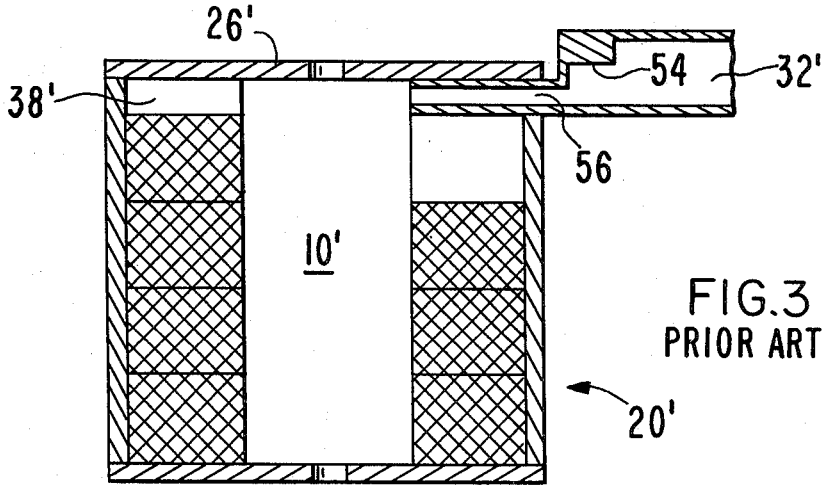
FIG.3
PRIOR ART
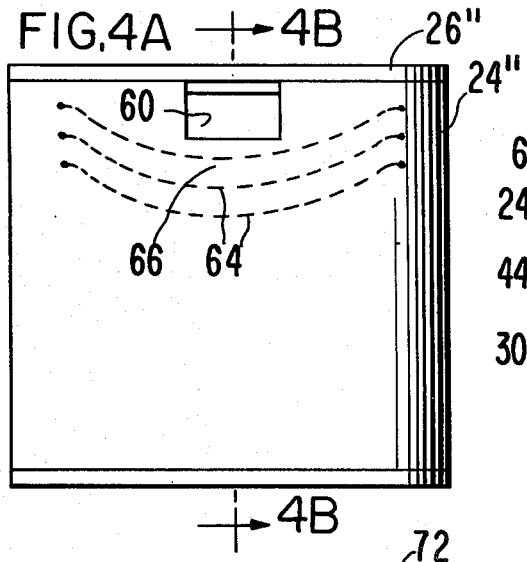
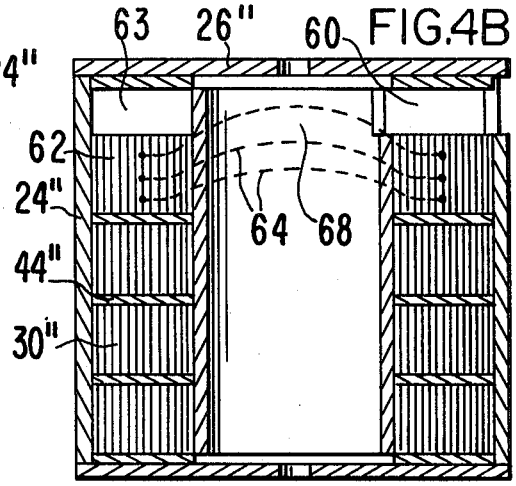
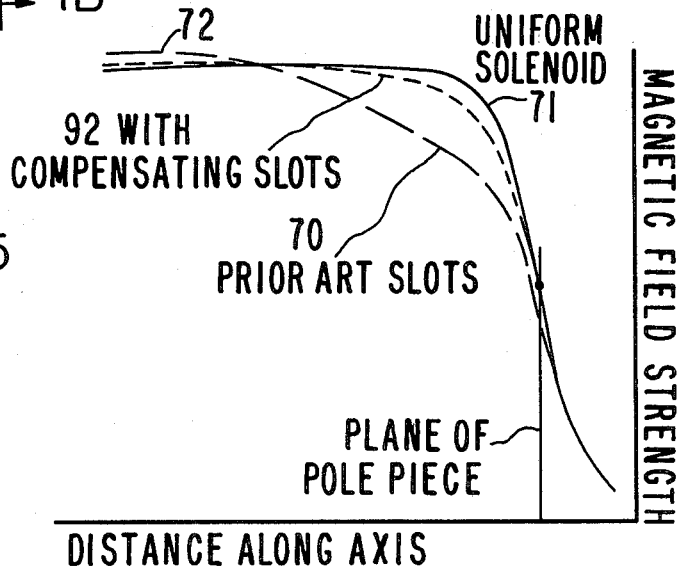
FIG.5

UNIFORM FIELD SOLENOID MAGNET WITH OPENINGS

DESCRIPTION

Background of the Invention

In most linear-beam electron tubes, such as klystrons and traveling-wave tubes, the electron beam is held focused into a cylindrical outline by a uniform magnetic field directed along the beam axis. In high-power tubes the magnetic field is typically produced by a solenoid coil outside the tube and coaxial with the beam. An iron shell encloses the solenoid to confine the field to the interaction region of the tube and to make it as uniform as possible throughout that region. The diameter of the beam is typically much smaller than the solenoid, so the field very close to the axis is the only significant part.

FIG. 1 illustrates a prior-art klystron 10 in its focusing magnet 20. Tube 10 slides into magnet 20 from the top. Klystron 10 comprises an electron gun 11 for producing a convergent beam 12 of electrons. Beam 12 passes through a hollow drift-tube 14 where it interacts with the electromagnetic fields of resonant cavities 16, 18 to amplify a signal wave fed into input cavity 16 through an input transmission line (not shown) which is typically a small coaxial cable.

In the region of cavities 16, 18, beam 12 is held focused in a pencil shape by an axial magnetic field produced by solenoid magnet 20. Beyond the interaction region it leaves the magnetic field and expands by its space-charge repulsion to land on the inner surface of a large collector bucket 22.

Magnet 20 has a ferromagnetic shell comprising an outside cylinder 24 joined to ferromagnetic end-plates 26. End-plates 26 are in magnetic contact with inner polepieces 27 which are an integral part of klystron 10. Each polepiece 27 has a small central holes 48, 50 for passing beam 12. Outside of holes 48, 50 the magnetic field falls off rapidly to a negligible value.

Magnet 20 comprises a number of solenoidal coils 30. However, a single long solenoidal winding is often used. To obtain a truly uniform field, coils 30 should extend all the way between iron end-plates 26. However, to carry away the high output power of klystron 10, a waveguide 32 must extend from a coupling aperture 34 in output cavity 18, through a vacuum-tight dielectric window 36 to an external useful load (not shown). Therefore, in the prior art coils 30 could extend axially only to the bottom plane 37 of waveguide 32, leaving a magnetically un-energized gap 38 adjacent the output polepiece 27.

In the construction shown by FIG. 1 cavities 16, 18 are tuned by tuner plates 40 moved in and out by rods 42. Coils 30 are separated by non-magnetic plates 44 which provide mechanical support and thermal cooling. Plates 44 have passages for tuner rods 42.

FIG. 2 is a schematic graph of the axial magnetic field strength produced by magnet 10 when all coils 30 have the same current density. The field has a uniform value 46 over most of the interaction region, falling rapidly to almost zero near the entrance aperture 48 and exit aperture 50 in polepieces 27. Due to the gap 38 beyond coils 30, the flux lines, spread out in this region and the axial field strength 52 falls off gradually. If the coils 30 were continued, the field 53 would be uniform almost to aperture 50. In the output region of a high-power linear-beam tube the beam has bunches of high space-charge density and also suffers from electromagnetic defocusing forces. Therefore the weakened focusing field 52 causes interception of electrons on the interaction structure, with consequent loss of power and dangerous heating.

Various schemes have been devised to reduce the magnetic field distortion. Increasing the current density in the upper solenoid section 30 increases the field in the output region, but creates an undesirable peak in the field before that. U.S. Pat. No. 2,963,616 issued Dec. 6, 1960 to Richard B. Nelson and Robert S. Symons describes a means illustrated by FIG. 3, which shows only the magnet 20' and output waveguide 32' of klystron 10'. Here waveguide 32' is stepped down via an impedance transformer 54 to a very shallow waveguide 56 in the region inside focusing magnet 20'. The height of the unenergized space 38' is thus reduced, decreasing the fall-off of field strength.

Another prior-art scheme is described in U.S. Pat. No. 2,939,036 issued May 31, 1960 to Richard B. Nelson. Here a shallow output waveguide is run up alongside the collector, parallel to the tube axis instead of outward perpendicular to it. Unfortunately this scheme is limited to relatively low-power tubes. In high-power tubes the collector is larger than the tube body and would interfere with the waveguide.

The solenoid coils 30 (FIG. 1) are sometimes wound with wire. Another useful construction illustrated by FIGS. 4A and 4B, uses coils 30'' wound spirally of thin metallic foil. Aluminum foil is usually used, insulated by an anodized surface. Heat is conducted out of the foil axially via a short all-metal path to heat sinks 44'' which are for example annular copper plates between foil windings 30''. With foil coils one can cut out a notch 60 in the end coil 62 to allow passage of the output waveguide. Notch 60 forces the current flow lines 64 to concentrate below notch 60 by adding axial components to the flow. Around the remaining periphery of coil 62 the current is free to spread throughout the cross section of coil 62. A single notch 60 would thus create an asymmetric current pattern which would cause a magnetic flux line following the axis to deviate away from the axis near the output waveguide end of the magnet. This would bend the electron beam. To correct this distortion a second notch 63 is cut in coil 62, 180 degrees from notch 60 and shaped to have a 180 degree rotational symmetry with notch 60. The resulting current flow lines 64 are confined in regions 66 under notches 60, 63 but are free to spread out in the intervening regions 68. They form a saddle shape, symmetric with respect to a 180 degree rotation about the axis. The magnetic flux lines generated by the current have the same symmetry, and the magnetic equipotentials are saddle-shaped surfaces. The axial magnetic flux line follows the axis throughout. Since the electron beam is much smaller than the magnet, the tilted off-axis fields are unimportant.

The current can spread to the top end of coil 62 in inter-slot regions 68, so the fall-off of axial magnetic field strength is not as drastic as in the case of FIGS. 1, 2 where the whole coil is cut short. Nevertheless, the total current in the top half of coil 62 is less than in the bottom half, so there is a substantial fall-off of field.

In FIG. 5, curve 70 is a graph of axial magnetic field strength as experimentally measured for a coil as illustrated by FIG. 4. For comparison, curve 71 shows the field for a uniform solenoid extending clear to the polepiece, with a small hole in the polepiece. This latter would be the ideal condition. Note the rise 72 in the field at a distance from the polepiece. This is due to the concentration of current under notches 60, 62.

Summary of the Invention

The object of the invention is to provide a solenoid magnet which can maintain a constant axial field throughout the interaction region of a linear-beam electron tube while permitting the outward passage of a waveguide through it.

This object is realized by providing a solenoid coil with oppositely located openings near a first end to pass the waveguide and preserve symmetry. Near the other end and spaced betwen the openings are regions which impede the current flow, forcing current to concentrate near the first end in these parts of the periphery. Thus the average currents near the two ends can be made equal. Hence the axial magnetic field can be made approximately constant. The coil can be wire-wound with the turns having a saddle-shaped symmetry. In a foil-wound coil the openings and the impeding regions can be portions cut out of the foil winding.

BRIEF DESCRIPTION OF THE DRAWINGS

FIG. 3 is a schematic cross section of a prior-art magnet and a portion of its electron tube.

FIG. 4A is a schematic side view of an improved prior-art magnet.

FIG. 4B is an axial section of the magnet of FIG. 4A.

FIG. 5 is a graph of magnetic fields in several magnets.

DESCRIPTION OF THE PREFERRED EMBODIMENTS

The invention will be described mainly as embodied in foil-wound magnet coils. It will also be shown that it may be embodied in wire-wound coils.

Figure 1:
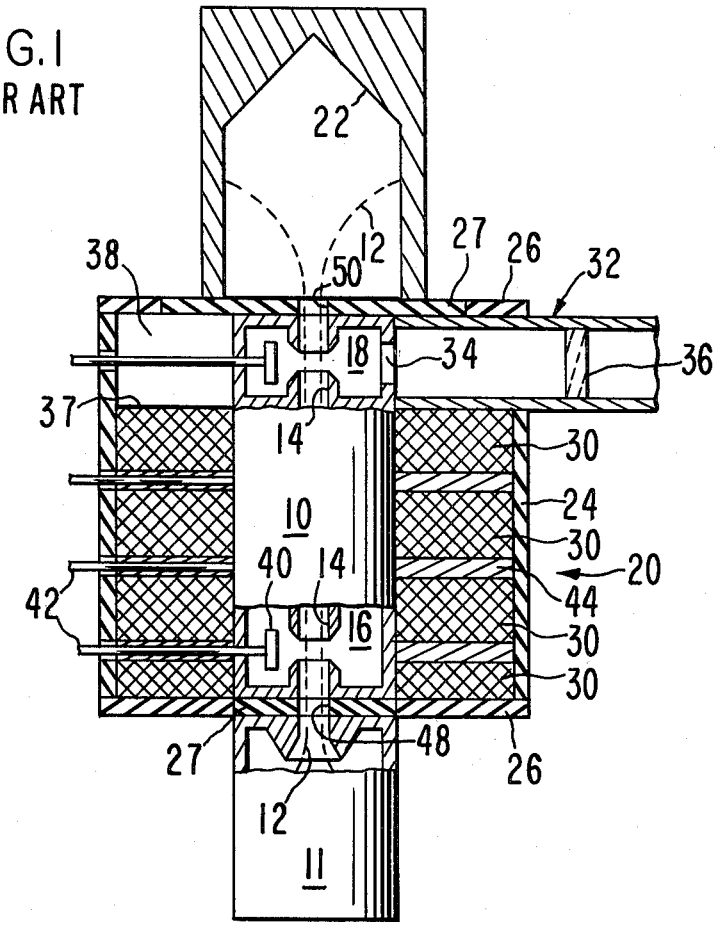
FIG. 1 PRIOR ART
FIG. 1 is a schematic cross section of a klystron in its prior-art magnet.
Figure 2:
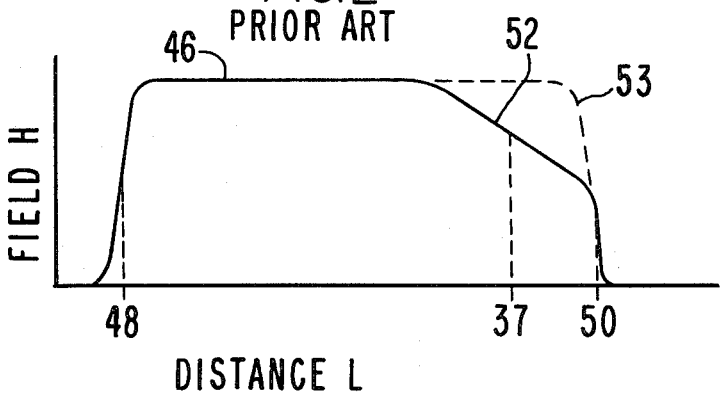
FIG. 2 PRIOR ART
FIG. 2 is a schematic graph of the axial magnetic field strength of the magnet of FIG. 1.
Figure 6:
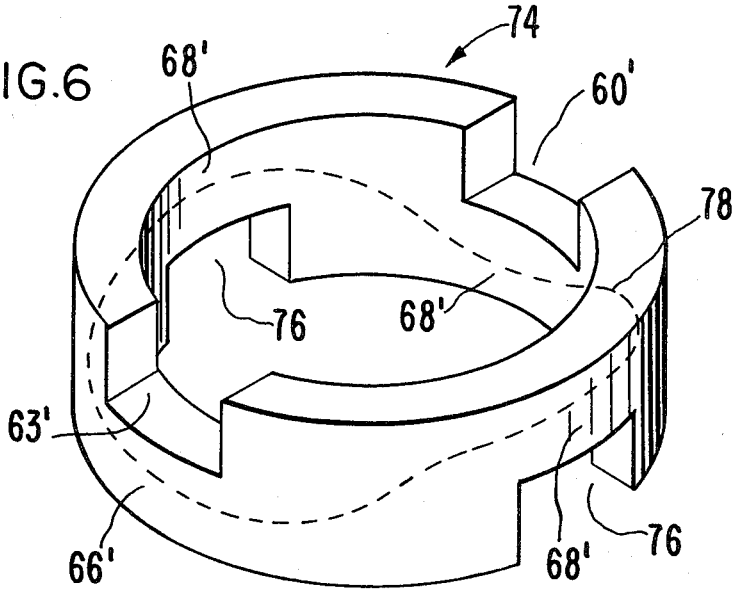
FIG. 6 is a schematic perspective view of a magnet coil embodying the invention.

FIG. 6 is a perspective view of a foil-wound magnet coil embodying the invention. The coil would be the end coil of a solenoid magnet, arranged the same as end coil 62 of FIGS. 4 at the output end of a linear-beam electron tube. The coil 74 has a notch 60' in its upper end to pass an output waveguide (not shown). An opposite, symmetric notch 63' compensates for bending the axial field line, as described in connection with FIGS. 4. Between notches 60' and 63' and azimuthally disposed between them, are another pair of notches 76 in the other end of the coil 74. Notches 60', 63' force the current flow lines 78 to concentrate beneath them at their locations 66' on the coil's perimeter.

Compensating notches 76 similarly force current lines 78 to concentrate above them at their locations 68' on the perimeter. As a result, flow path 78 traces a saddle-shaped curve, oscillating above and below the midplane of coil 74. The resulting magnetic equipotential surfaces are also saddle-shaped If the pair of compensating notches 76 are also symmetric with respect to a 180 degree rotation about the axis, the magnetic flux line on the axis will follow the axis accurately, as described in connection with FIGS. 4. The effect of the rotational symmetry can be visualized by noting that each vector component of current produces a vector component of field at each point on the axis. If the current vector is rotated 180 degrees, the field field vector will also be rotated 180 degrees, maintaining its original angle with the axis. The original vector and its rotated image lie in the same plane (containing the axis) so their components perpendicular to the axis cancel. The 180 degree rotational symmetry of current thus must produce only an axial field component on the axis. The addition of compensating slots 76 can balance out the net downward displacement of current lines 78 by the needed slots 60', 63'. This is seen to be obvious if slots 76 are identical with slots 60', 63', making the structure symmetric with respect to an axial inversion plus a 90 degree rotation. However, there may be structural or thermal reasons to make slots 76 of a different shape. Whatever their shape, as long as the rotational symmetry is preserved, the axial field will be straight. By proper slot dimensions and choice of coil length, the required compensation of axial field strength fall-off may be achieved almost perfectly. Returning to FIG. 5, curve 92 is a graph of measured axial field strength for a coil with compensating notches, showing the great improvement over the prior art coil of FIGS. 4 (curve 70).

Figure 7:
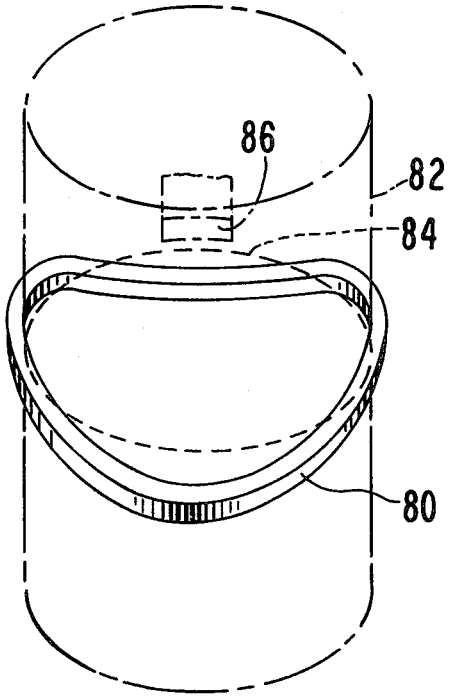
FIG. 7 is a schematic perspective of an alternate embodiment of the invention.

FIG. 7 illustrates how the invention may be embodied in a wire-wound coil. The wires 80 are wound on the surface of a cylinder 82. They alternately rise above and fall below a transverse center-plane 84. The waveguide 86 would pass through the opening between the coil 80 and the magnet end-piece at a point where the wires are removed downward away from the end-piece. This coil bears some resemblance to the "baseball" coils used in some plasma-confining experiments. It is, however, different in both form and function because it produces a uniform field instead of a confining magnetic-mirror field.

Figure 8:
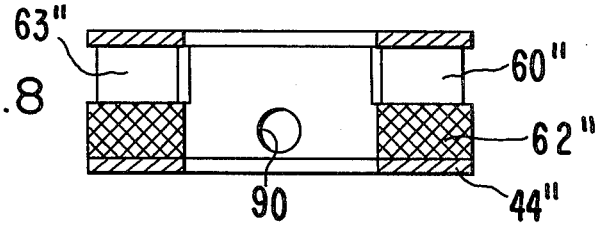
FIG. 8 is a schematic axial section of an alternate embodiment.

FIG. 8 is a schematic cross-section of a foil coil embodying the invention. It illustrates that the compensating regions near the bottom of the coil need not be identical with the working slots 60'', 63'' and need not even be slots. A pair of holes 90 of any proper symmetrical shape can provide the necessary current-shaping impediment. Also, the compensating regions need not extend clear through coil 62'' radially. Another embodiment is to use narrow slots which do not interfere with axial heat flow as much as wide ones. Each compensating region may comprise a number of slots, grooves or holes.

It will be obvious to those skilled in the art that many other embodiments may be made within the scope of the invention. The embodiments described above are exemplary and not limiting. Any means of impeding current flow at the proper places will suffice. The saddle-shaped distortion off the axis may be reduced by using more than the two pairs of current-impeding regions, each having the required symmetry. The use of more than two pairs will, of course, increase the electrical resistance of the coil.

The scope of the invention is to be limited only by the following claims and their legal equivalents.

What is claimed is:

1. A generally solenoidal electromagnet coil for directing a stream of charged particles by a generally uniform magnetic field along the axis of said solenoid, an even number of first regions impeding the flow of coil current spaced circumferentially near one end of said coil whereby said current is forced to divert away from said one end around said first regions, the improvement wherein being an equal even number of second regions impeding the flow of coil current and diverting it from circumferential flow, said second regions being circumferentially spaced between said first regions and axially removed from said one end.

2. The coil of claim 1 wherein said first regions are symmetrical with respect to a 180 degree rotation about said axis.

3. The coil of claim 1 wherein said second regions are spaced azimuthally about said axis midway between said first regions.

4. The coil of claim 2 wherein said second regions are symmetrical with respect to a 180 degree rotation about said axis.

5. The coil of claim 1 wherein said coil consists of a bundle of generally parallel filamentary conductors and said regions are formed by periodic axial displacement of said conductors from a plane perpendicular to said axis.

6. The coil of claim 1 wherein said coil comprises a conductor of circumferentially wound metallic ribbon.

7. The coil of claim 6 wherein said first regions comprise notches in said one end of said coil.

8. The coil of claim 7 wherein said second regions comprise notches in the end of said coil opposite said one end.

9. The coil of claim 7 wherein said second regions comprise holes in said coil.

* * * * *